US010517358B1

(12) United States Patent
Olsson

(10) Patent No.: US 10,517,358 B1
(45) Date of Patent: Dec. 31, 2019

(54) CANTED RING

(71) Applicant: Gudmund Jos Olsson, Rochester, NY (US)

(72) Inventor: Gudmund Jos Olsson, Rochester, NY (US)

( * ) Notice: Subject to any disclaimer, the term of this patent is extended or adjusted under 35 U.S.C. 154(b) by 0 days.

(21) Appl. No.: 16/411,766

(22) Filed: May 14, 2019

(51) Int. Cl.
*A44C 9/00* (2006.01)

(52) U.S. Cl.
CPC ..... *A44C 9/00* (2013.01)

(58) Field of Classification Search
CPC ..... A44C 9/00; A44C 9/0076; A44C 9/0053
USPC ..... D11/26, 28, 29; 63/15.1, 15, 15.2, 15.3, 63/15.4, 15.45
See application file for complete search history.

(56) References Cited

U.S. PATENT DOCUMENTS

| | | | | | |
|---|---|---|---|---|---|
| 2,084,008 | A * | 6/1937 | Shields | A44C 9/00 | 63/15 |
| 3,261,181 | A | 7/1966 | Scott | | |
| 4,043,145 | A | 8/1977 | Chervin | | |
| D438,075 | S * | 2/2001 | Van Meter | D11/26 | |
| 6,212,908 | B1 * | 4/2001 | Melas | A44C 9/00 | 63/15 |
| D491,833 | S * | 6/2004 | Flynn | D11/26 | |
| D686,101 | S * | 7/2013 | Dailey | D11/26 | |
| 2003/0221450 | A1 * | 12/2003 | Selinger | A44C 9/00 | 63/15 |

* cited by examiner

*Primary Examiner* — Jack W Lavinder
(74) *Attorney, Agent, or Firm* — Tracy Jong Law Firm; Tracy P. Jong; Cheng Ning Jong

(57) ABSTRACT

A ring for a finger of a user, the finger extending from a root of the finger at a palm of a hand at an angle that is not a right angle, the ring including a canted band including a bottom portion, a top portion and a cant angle, wherein the ring is capable to be worn by the user with the ring tangent to the palm at the root of the finger, increasing the comfort experienced by the user as the ring is disposed on the finger of the user and increasing the secure coupling of the ring to the finger by disposing the ring against the palm.

12 Claims, 9 Drawing Sheets

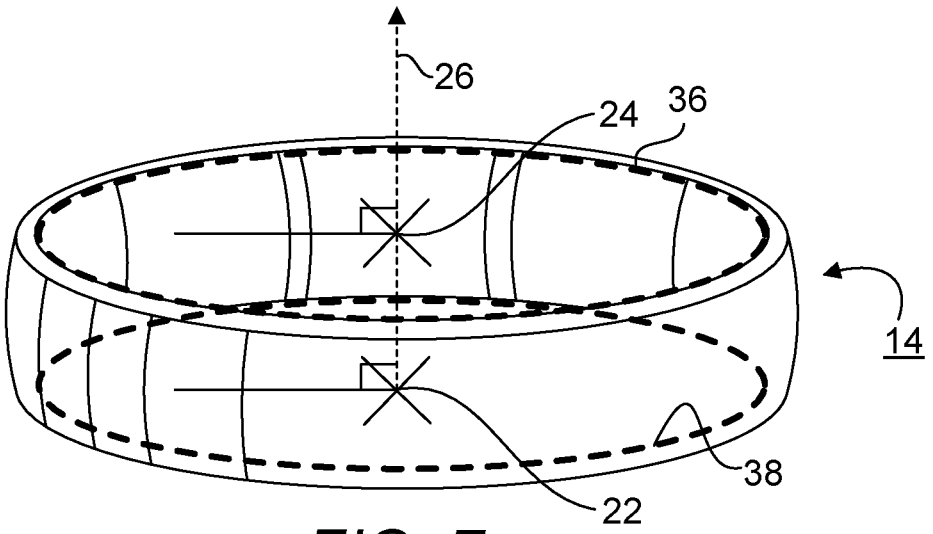
FIG. 7
PRIOR ART
FIG. 8
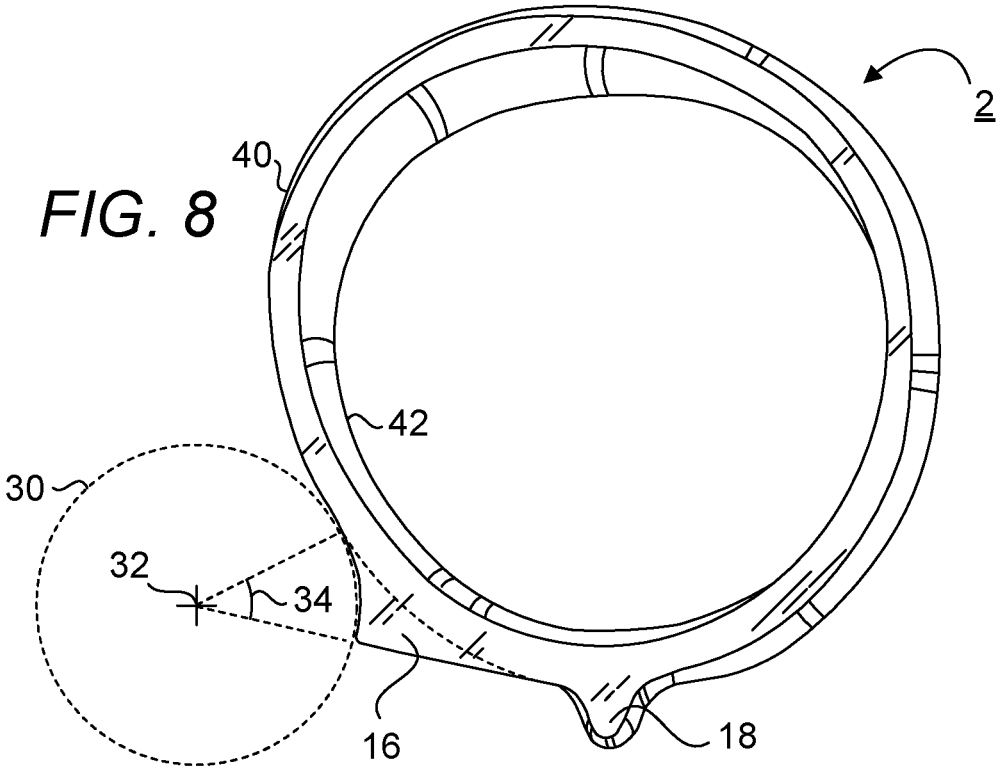

CANTED RING

BACKGROUND OF THE INVENTION

1. The Field of the Invention

The present invention relates to a finger ring canted for comfort and to a finger ring that is capable of being retained securely and disposed as intended on a finger. More specifically, the present invention is directed to a finger ring canted for comfort and to a finger ring that is capable of being retained securely to reduce turning on a finger and it is a ring that can be easily adjusted to prominently position and display its face.

2. Background Art

During use, a traditional circular ring tends to allow the ring to rotate and be orientated in a manner that the face or crown of the ring is no longer prominently displayed or the crown is disposed in a position such that it can be more easily damaged as the position that the ring has assumed will expose it to wear. A traditional ring, e.g., a wedding ring, is shaped from a stock band having a central axis which runs through the ring centrally and the central axis is disposed at substantially right angle to a plane on which the ring is disposed, i.e., the ring sits squarely across the finger. Various attempts have been made to minimize this problem in the past. In some occasions, rings have been resized such that they fit more tightly while they are worn on fingers. Although such a solution only partially alleviates the problem, it works well for those who can tolerate rings that fit too tightly and impinge upon their fingers. By putting stress on the knuckle, the ring that has been fitted too tightly will cause the enlargement of knuckle and thus causing the need for further resizing, making the ring even looser once it is over the knuckle. In other occasions, additional parts have been added to effectively alter the opening of a ring, e.g., with resilient materials and springs, etc., to more securely hold the ring on its wearer's finger. With a tighter fit on a finger, unintended rotations of a ring about a finger can also be minimized. If unintended rotations of the ring are reduced, the crown of the ring will be more prominently displayed and the location of the crown is disposed at a location intended by the wearer, reducing the amount of wear-and-tear that could potentially occur to the ring. For instance, if a ring had been unintendedly rotated such that its crown is now disposed on the palm side of a finger, the performance of daily chores could have easily exposed the crown to hard objects which could harm it and worsen its appearance. Most prior attempts to make a ring fit more securely on a finger involve providing adjustable rings where at least one additional part is provided to the ring to restrict and adjust the size of the opening of the ring based on the wearer's finger size. No attempts have been previously made to provide a unitary ring having features capable of addressing the problems disclosed elsewhere herein.

U.S. Pat. No. 4,043,145 to Chervin (Hereinafter Chervin) discloses a contoured finger ring having a finger receiving aperture with five approximately equal sides which is configured to pass the knuckle therethrough while the ring is at a ninety degree angle to its proper position thereon and to lock on the finger proximally of the knuckle when righted. According to Chervin, its ring resists turning about the knuckle and is exteriorally configured to accommodate adjacent fingers, thereby suppressing discomfort due to pressure and rubbing against the adjacent fingers. Chervin's ring must be made in the shape disclosed by Chervin which is a significant departure from the traditional shape, i.e., round. Further, Chervin also relies on some amount of compression exerted on the finger for the ring to stay more securely on the finger. Yet further, for its ring to take on the shape Chervin discloses, its ring takes up additional exterior spaces which ultimately make the ring uncomfortable to wear.

Both U.S. Pat. No. 3,261,181 to Scott (Hereinafter Scott) and Japanese Pat. Pub. No. JP2018011782 of Ryoichi (Hereinafter Ryoichi) and Japanese Pat. Pub. No. JP2012000418 of Maizuru (Hereinafter Maizuru) all disclose a ring whose circumferential shape is the result of modifying the round shape of a traditional ring. Similarly, Scott's, Ryoichi's and Maizuru's ring must be made in the shape disclosed by Scott and Ryoichi which is also a significant departure from the traditional shape, i.e., round. Therefore, Scott, Ryoichi and Maizuru's ring also suffer from all of the disadvantages of the Chervin ring.

WIPO Pat. Pub. No. 2004066774 of Hoshina (Hereinafter Hoshina) discloses a round corner quadrangular ring, wherein three or four sides of the ring having a round corner quadrilateral are cut out to provide the shape of a part (a) of an ellipse or circle, a gem holding part provided at a decorative part is formed in an annular shape (b), the annular shape is connected to a ring part through a part, a part of the connection part is cut out in two directions (d), a gem is installed, and the cutout portion is fixed with a screw or a pin (f), whereby the ring is not rotated when installed. According to Hoshina, the pressing feeling against an adjacent finger by a finger having the ring can be reduced, the chance of contact with an object is less even when the object is held by a palm, and the decorative part is not caught by clothing. Again, Hoshina provides a ring where the rotation of the ring is addressed using the shape of the ring and not additional parts. However, the cut out parts that are disposed between two adjacent fingers, necessitating a look of the ring that is different from the look of a traditional ring as there are two cutouts flanking the decorative part of the ring.

There exists a need for a finger ring that is comfortable to wear, securely held on a finger to which it is put on and a ring which does not come in multiple parts geared towards making the ring securely held and positioned on the finger.

SUMMARY OF THE INVENTION

In accordance with the present invention, there is provided a ring for a finger of a user, the finger extending from a root of the finger at a palm of a hand at an angle that is not a right angle, the ring including a canted band including a cant angle, wherein the ring is capable to be worn by the user with the ring tangent to the palm at the root of the finger, increasing the comfort experienced by the user as the ring is disposed on the finger of the user and increasing the secure coupling of the ring to the finger by disposing the ring against the palm.

In one embodiment, the canted ring further includes a bottom portion and the ring further includes a rotation stop feature disposed on the bottom portion, the rotation stop feature including a curved segment configured to partially cup a second finger adjacent the finger and the curved segment is disposed between the second finger and the finger while the ring is disposed on the finger, to prevent rotation of the ring about the finger and further increase the secure coupling of the ring to the finger by reducing turning of the ring about the finger.

In one embodiment, the ring further includes a knob disposed on the bottom portion, wherein the knob is configured to serve as a tactile indicator of the rotational position of the ring with respect to the finger and as a grip for facilitating rotation of the ring to a desired rotational position.

In one embodiment, the curved segment includes a radius of about ⅞ inch to about 1 and ⅛ inches and about 45 degrees sweep. In one embodiment, the cant angle is about 45 degrees. In one embodiment, the ring further includes an actuation button disposed on the bottom portion, the actuation button operably connected to an electronic device.

An object of the present invention is to provide a ring that can be worn more comfortably and held more securely in the intended position on a finger.

Another object of the present invention is to provide a ring that can be worn more comfortably and held more securely to avoid turning on a finger by following the contour of a palm at which the ring is disposed.

Another object of the present invention is to provide a ring whose preferred roll angle and position can be maintained.

Another object of the present invention is to provide a ring whose roll angle can be adjusted with minimal or concealed effort.

Whereas there may be many embodiments of the present invention, each embodiment may meet one or more of the foregoing recited objects in any combination. It is not intended that each embodiment will necessarily meet each objective. Thus, having broadly outlined the more important features of the present invention in order that the detailed description thereof may be better understood, and that the present contribution to the art may be better appreciated, there are, of course, additional features of the present invention that will be described herein and will form a part of the subject matter of this specification.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which:

FIG. 7 depicts a traditional ring.

FIG. 8 is a front perspective view of one embodiment of a present ring, depicting a feature that minimizes its rotation when worn on a finger.

PARTS LIST

Figure 1:
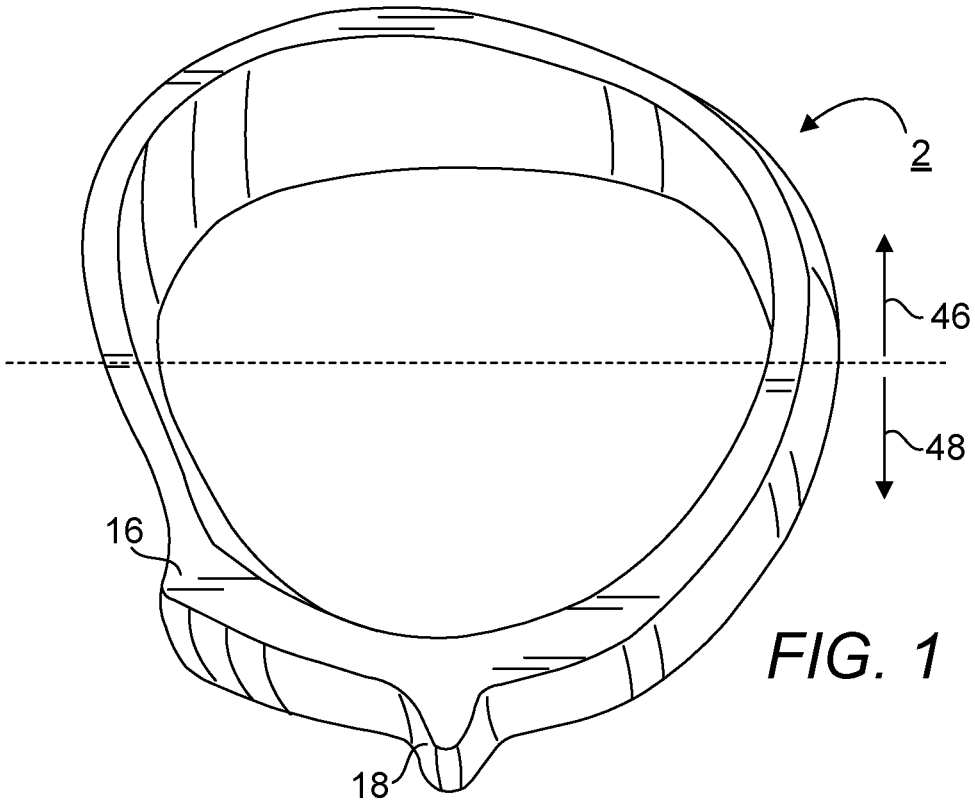
FIG. 1 is a bottom front perspective view of one embodiment of a present ring.

2—ring
4—third or ring finger
6—second or middle finger
7—fourth or baby finger
8—hand
10—palm
12—edge of palm
14—traditional ring
16—rotation stop feature
18—knob
20—thumb
22—center of rear opening of ring
24—center of front opening of ring
26—central axis of ring
28—cant angle or angle between central axis of ring and front opening plane or rear opening plane
30—circle whose tangential segment to a ring provides a rotation stop feature
32—center of circle whose tangential segment to a ring provides a rotation stop feature
34—sweep angle of tangential segment to a ring that provides a rotation stop feature
36—front opening plane
38—rear opening plane
40—outer wall of ring
42—face of ring
44—actuation button
46—top portion or shank of ring
48—bottom portion or shank of ring
50—knuckle

PARTICULAR ADVANTAGES OF THE INVENTION

The present ring is canted so that it can be comfortably worn on a finger and the ring stays securely held in the desired position on the finger. As the present ring comes in a single piece, no additional parts are required. There are no additional parts to lose and maintain while the ring is more comfortable to wear compared to single-piece rings disclosed elsewhere herein as there are no extraneous parts disposed on the exterior wall of the present ring which come between two adjacent fingers. Further, the opening of the present ring is not shaped in a manner noticeably different from the opening of a traditional ring. For a user to gravitate towards a present ring, he or she does not need to first overcome the mental block that may come with using a ring with features that distinguish it from traditional rings with round openings as the present ring does come with a round opening. The same cannot be said about rings with openings of various shapes as those disclosed in Chervin, Scott, Ryoichi, Maizuru and Hoshina.

The present ring includes a rotation stop feature and a knob that are integrally built with the ring. Again, there are no additional parts to contend with. When a ring is worn on a finger, the rotation stop feature causes a ring to be disposed in a manner that its crown is disposed centrally on the top of the finger on the back side of the hand, prominently displaying the often fragile ornamental features of the crown. If the ring is disposed at a roll angle deviating from this ideal roll angle, the roll angle can be adjusted by the wearer by grasping the ring by the knob and rotating it to a desired roll angle. In one embodiment, at an ideal roll angle, the knob is disposed centrally on the bottom portion of the ring. Therefore, as long as the knob is detected either visually or by touch that it is disposed centrally on the bottom portion, the wearer can be confident that the crown is prominently displayed without verifying the need to verify by sight whether the crown is actually prominently displayed.

Further, a present ring is canted. Therefore, while disposed on the ring finger, the present ring is positioned such that it follows the contour of a palm rather than coming into contact with the baby finger adjacent the ring finger.

DETAILED DESCRIPTION OF A PREFERRED EMBODIMENT

The term "about" is used herein to mean approximately, roughly, around, or in the region of. When the term "about" is used in conjunction with a numerical range, it modifies that range by extending the boundaries above and below the numerical values set forth. In general, the term "about" is used herein to modify a numerical value above and below the stated value by a variance of 20 percent up or down (higher or lower).

Figure 2:
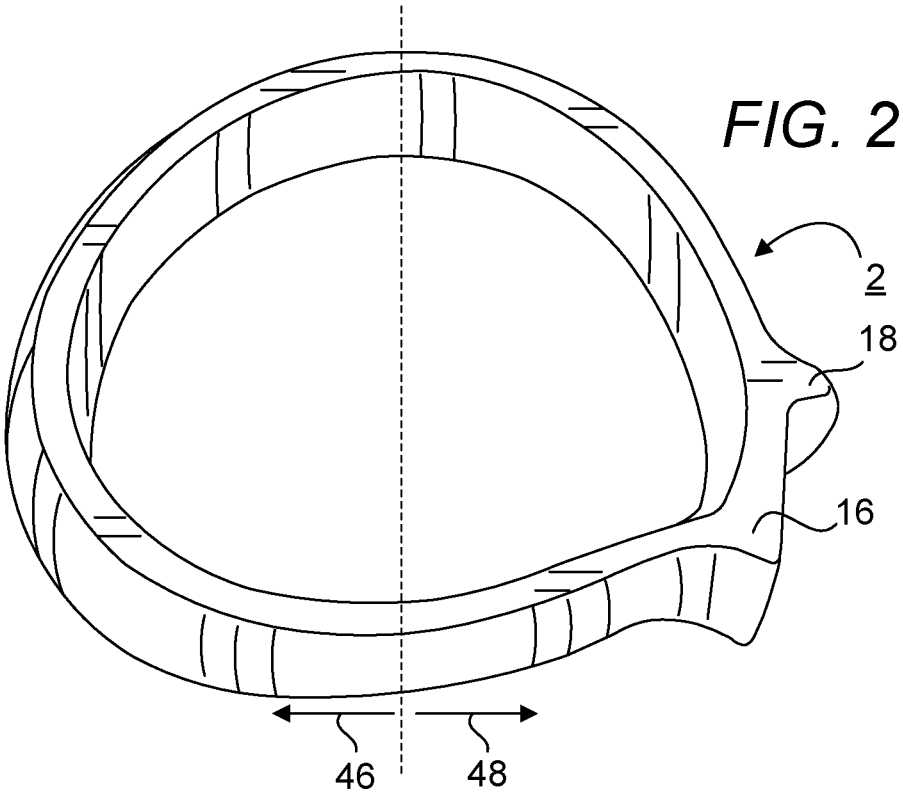
FIG. 2 is a right front perspective view thereof.
Figure 3:
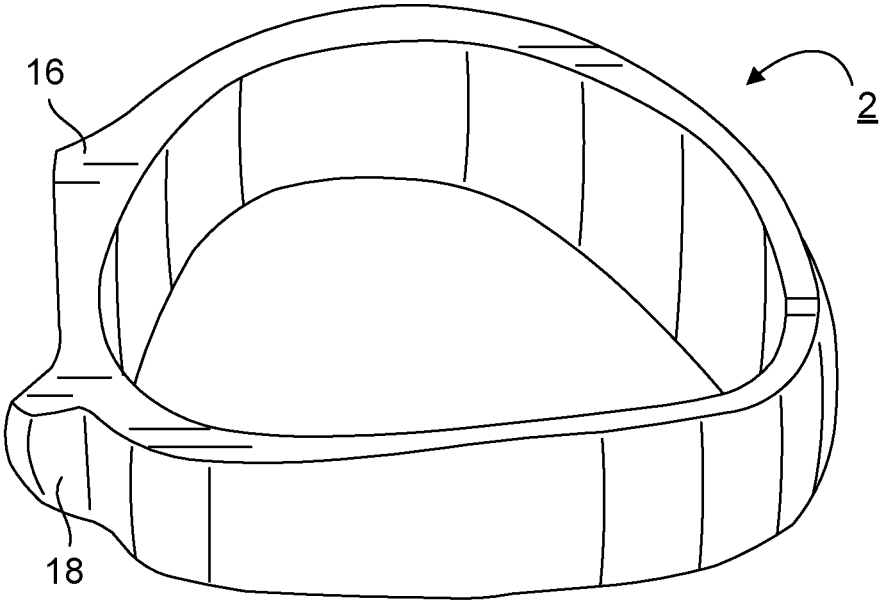
FIG. 3 is a left front perspective view thereof.
Figure 4:
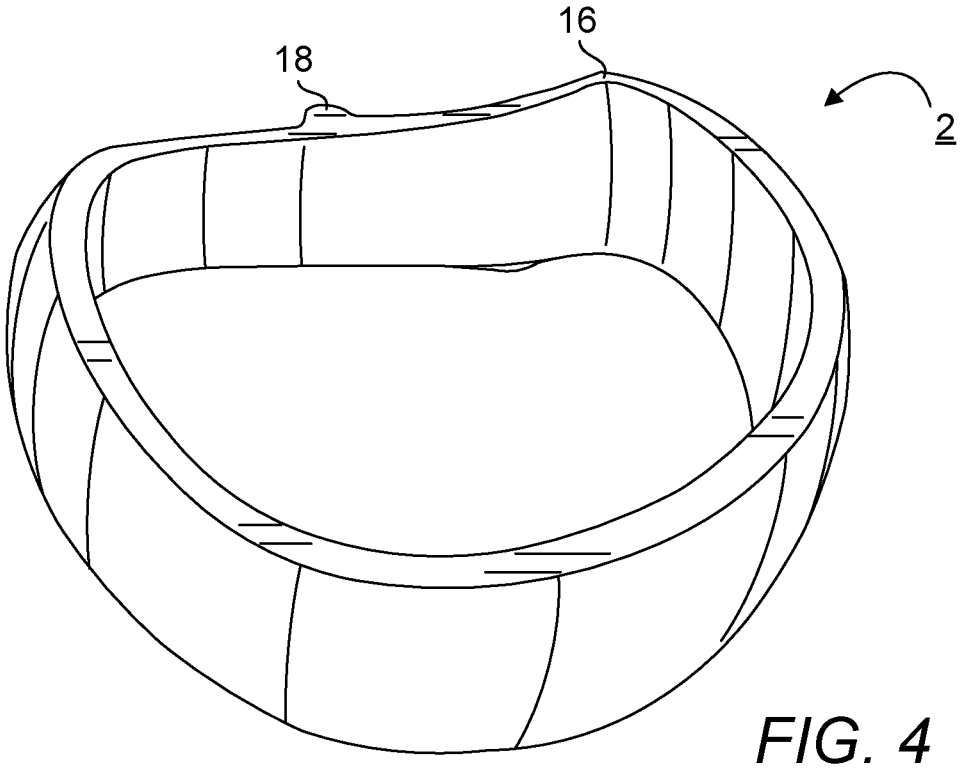
FIG. 4 is a top front perspective view thereof.
Figure 5:
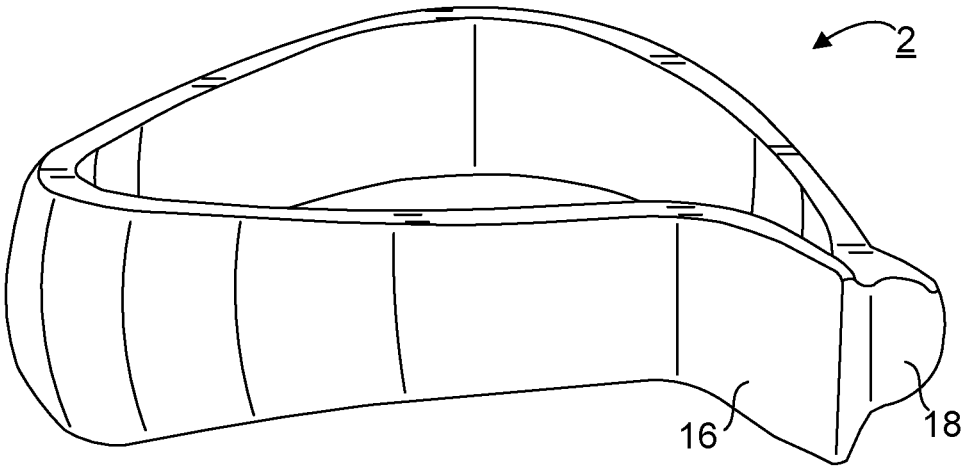
FIG. 5 is another right front perspective view thereof.

FIG. 1 is a bottom front perspective view of one embodiment of a present ring 2. FIG. 2 is a right front perspective view thereof. FIG. 3 is a left front perspective view thereof. FIG. 4 is a top front perspective view thereof. FIG. 5 is another right front perspective view thereof. In order to facilitate the ensuing disclosures, the ring is said to have a top portion 46 and a bottom portion 48. Upon putting the ring 2 on a finger, the top portion will be on the back of the hand side and the bottom portion will be on the palm side. The front part of the ring is the part of the ring disposed away from the hand when the ring is disposed on the finger while the rear part of the ring is the part of the ring disposed close to the hand. The ring 2 includes a rotation stop feature 16 and a knob 18 disposed on the bottom portion 48 of the ring 2.

Figure 6:
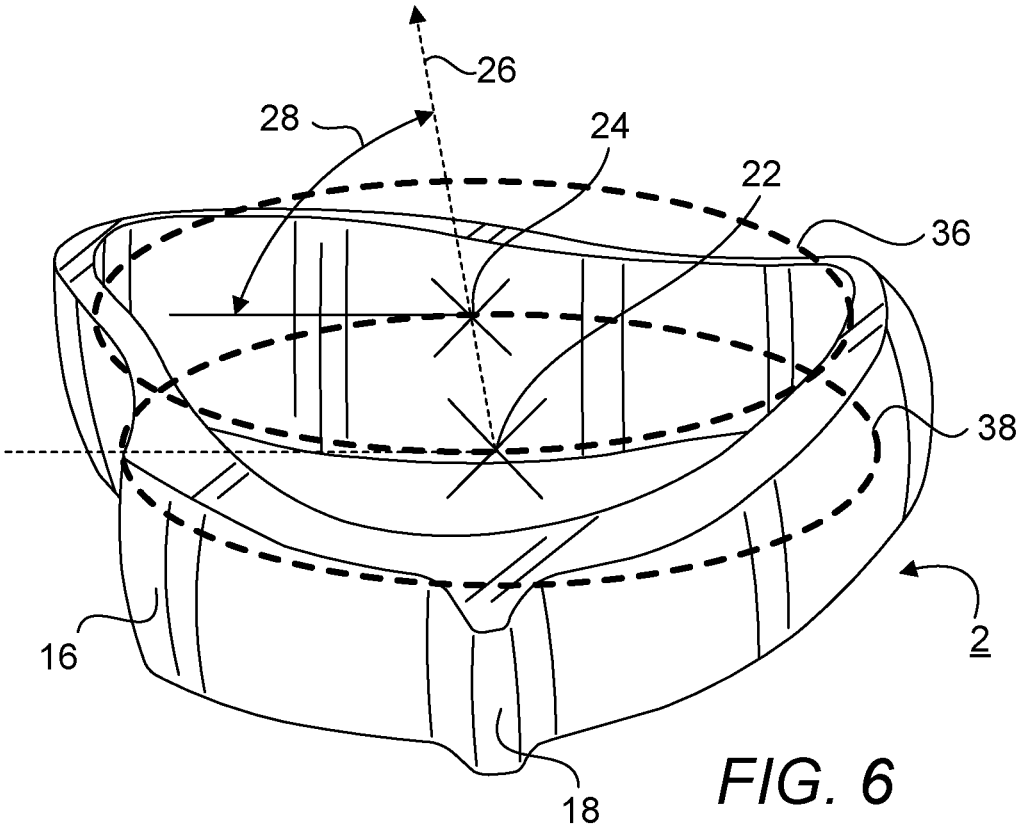
FIG. 6 is another bottom front perspective view of one embodiment of a present ring, depicting the manner in which a present ring is configured to allow it to be worn to follow the contour of the palm of a hand.

FIG. 6 is another bottom front perspective view of one embodiment of a present ring, depicting the manner in which a present ring 2 is configured to allow it to be worn to follow the contour of the palm of a hand. The ring 2 is essentially a band having a front opening plane 36 having a center 24 and a rear opening plane 38 having a center 22. The openings at the front and rear of the ring are substantially the same size. It shall be noted however that the central axis 26 of the ring is disposed at an angle that is not right angle with respect to either one of the two planes 36, 38. Rather, in one embodiment, the cant angle 28 or the angle between central axis 26 of ring 2 and outer opening plane 36 or inner opening plane 38 is about 45 degrees. Contrast this to a traditional ring 14 shown in FIG. 7 where its central axis is disposed at substantially right angle to either one of the front opening plane 36 and rear opening plane 38. It can be seen that with the cant angle 28 shown in FIG. 6, a wearer would be able to dispose the ring 2 tangent to the palm 10 at the root of the ring finger 4 on an edge 12 of the palm 10. The secure coupling of the ring to the finger is increased as the ring is disposed against the palm 10. Further, contrast this to Chervin's ring. It shall be noted that in Chervin, the use of the word "contour" is for describing the shape of its ring within the plane in which the ring is disposed. Therefore, although Chervin's ring is "contoured," all of its contours are disposed within one plane. In a present ring, a central axis disposed through the opening of the present ring is not perpendicular to either one of the opening planes of the ring.

FIG. 8 is a front perspective view of one embodiment of a present ring 2, depicting a feature that minimizes its rotation when worn on a finger. The rotation stop feature 16 is disposed on the bottom portion, the rotation stop feature including a curved segment configured to partially cup a second finger, e.g., the middle finger, adjacent the finger and the curved segment is disposed between the second finger and the finger while the ring is disposed on the finger, to prevent rotation of the ring about the finger. In one embodiment, the curved segment includes a radius of about ⅞ inch to about 1 and ⅛ inches and about 45 degrees sweep and it is disposed on the outer wall 40 on the bottom portion of the ring 2. The curved segment can essentially be defined as a circumferential segment of a circle centered at a point outside of the ring opening. A circle 30 with its center disposed at point labeled 32 is located outside of the ring to show the tangential segment to the ring which provides a rotation stop feature 16. In one embodiment, the sweep angle 34 of the tangential segment to a ring that provides a rotation stop feature 16 ranges from about 38 degrees to about 52 degrees.

Figure 9:
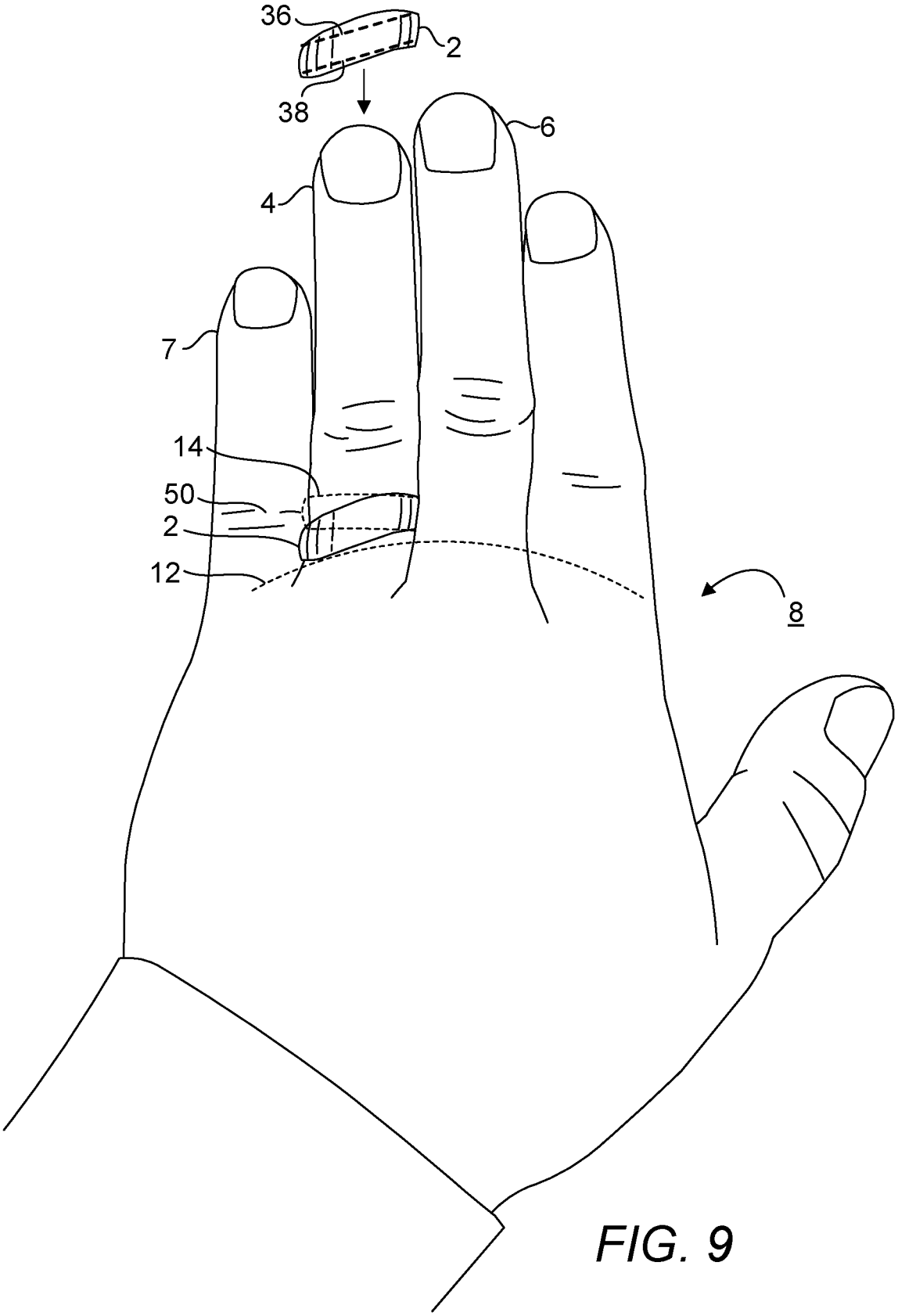
FIG. 9 is a diagram depicting the manner in which a present ring is worn on the ring finger when viewed from the back of a hand.
Figure 9A:
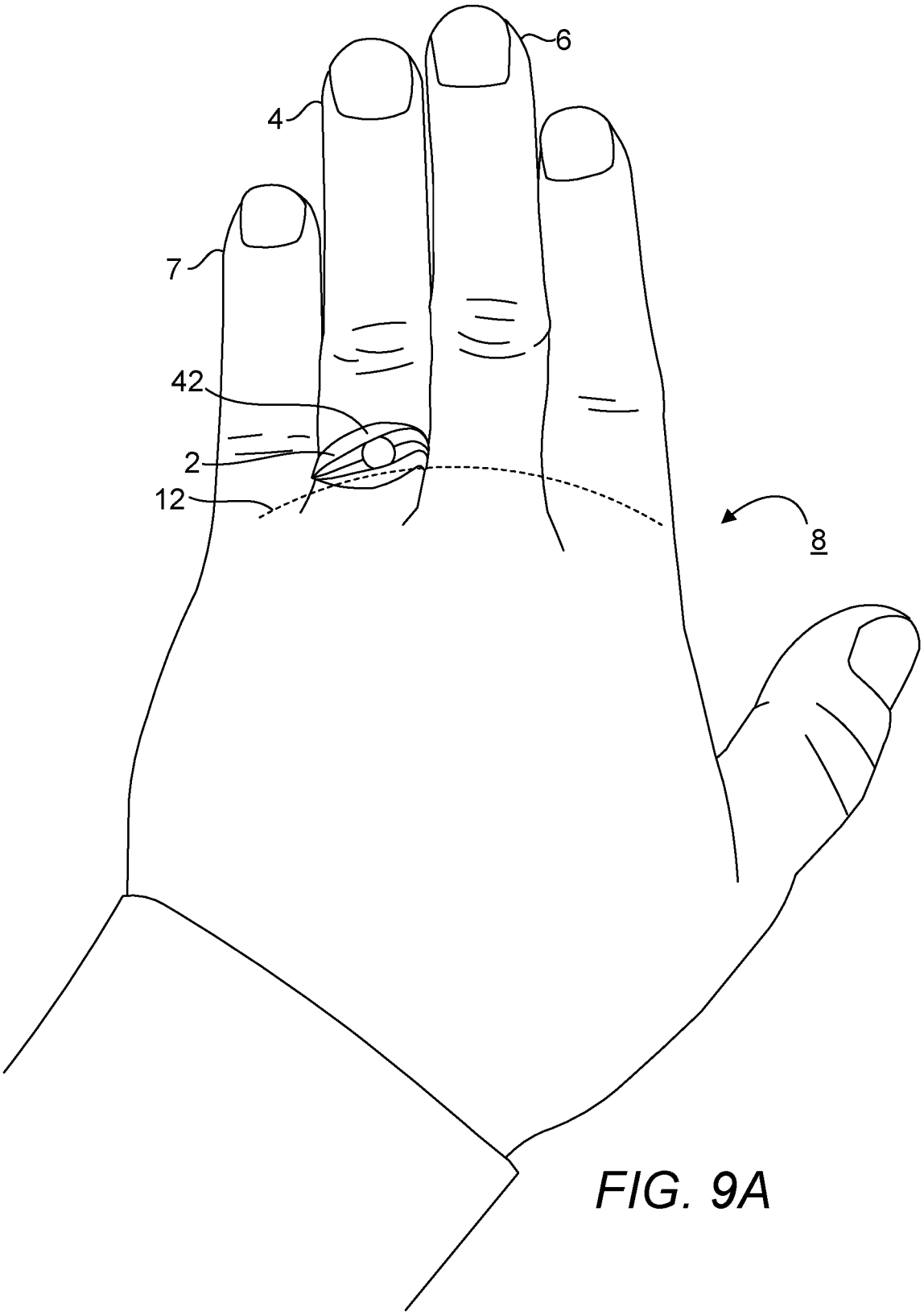
FIG. 9A is a top front perspective view of one embodiment of a present ring, depicting an ornamental feature disposed on the face of the ring.
Figure 10:
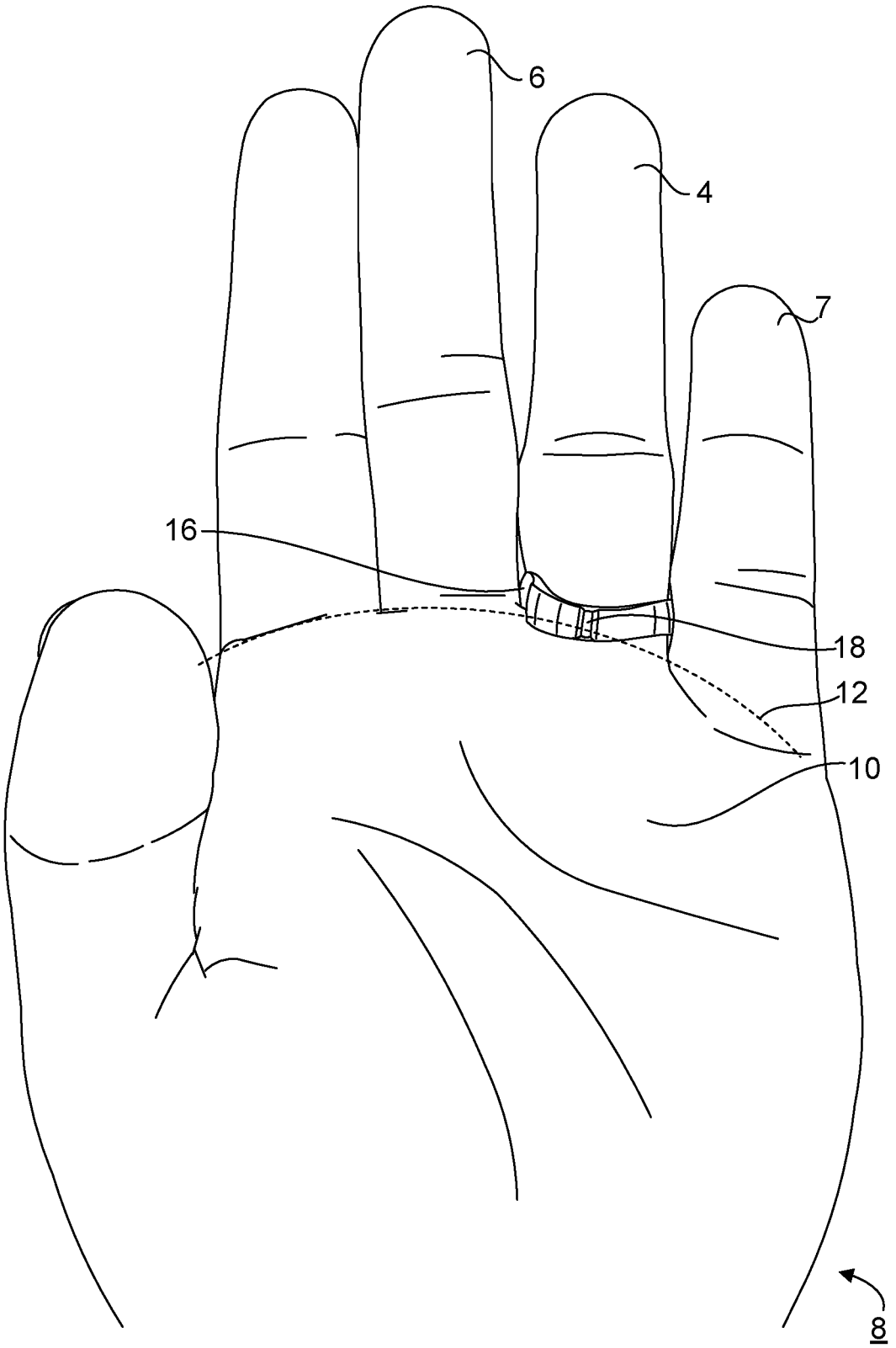
FIG. 10 is a diagram depicting the manner in which a present ring is worn on the ring finger when viewed from the palm side of a hand.

FIG. 9 is a diagram depicting the manner in which a present ring is worn on the ring finger when viewed from the back of a hand 8. FIG. 9A is a top front perspective view of one embodiment of a present ring, depicting an ornamental feature disposed on the face 42 of the ring 2. The ring 2 is configured for a ring finger 4, i.e., the finger between the middle finger 6 and baby finger 7 on a left hand 8. Referring to FIG. 9, the outline of a traditional ring 14 is superimposed therein to contrast the difference in the manner the two rings are seated. It shall be noted that present ring 2 is configured, as shown in FIG. 10, to allow it to be worn to follow the contour of the palm 10 of a hand 8. The ring 2 is also shown in a state prior to it being seated on the ring finger. Note the cant of the ring 2 due to the parallel planes 36, 38 representing the openings of the ring 2. In addition to providing a more aesthetically-pleasing appearance to some, the canted ring 2 is held more securely and comfortably on a finger without introducing an additional finger-tightening feature and the ring 2 does not collide with the knuckle joint of the baby finger 7. The latter is especially important if the wearer is active in sports, e.g., golf or playing an instrument.

FIG. 10 is a diagram depicting the manner in which a present ring is worn on the ring finger when viewed from the palm side of a hand. Again, it shall be noted that present ring 2 is configured to allow it to be worn to follow the contour of the palm 10 of a hand 8.

Figure 11:
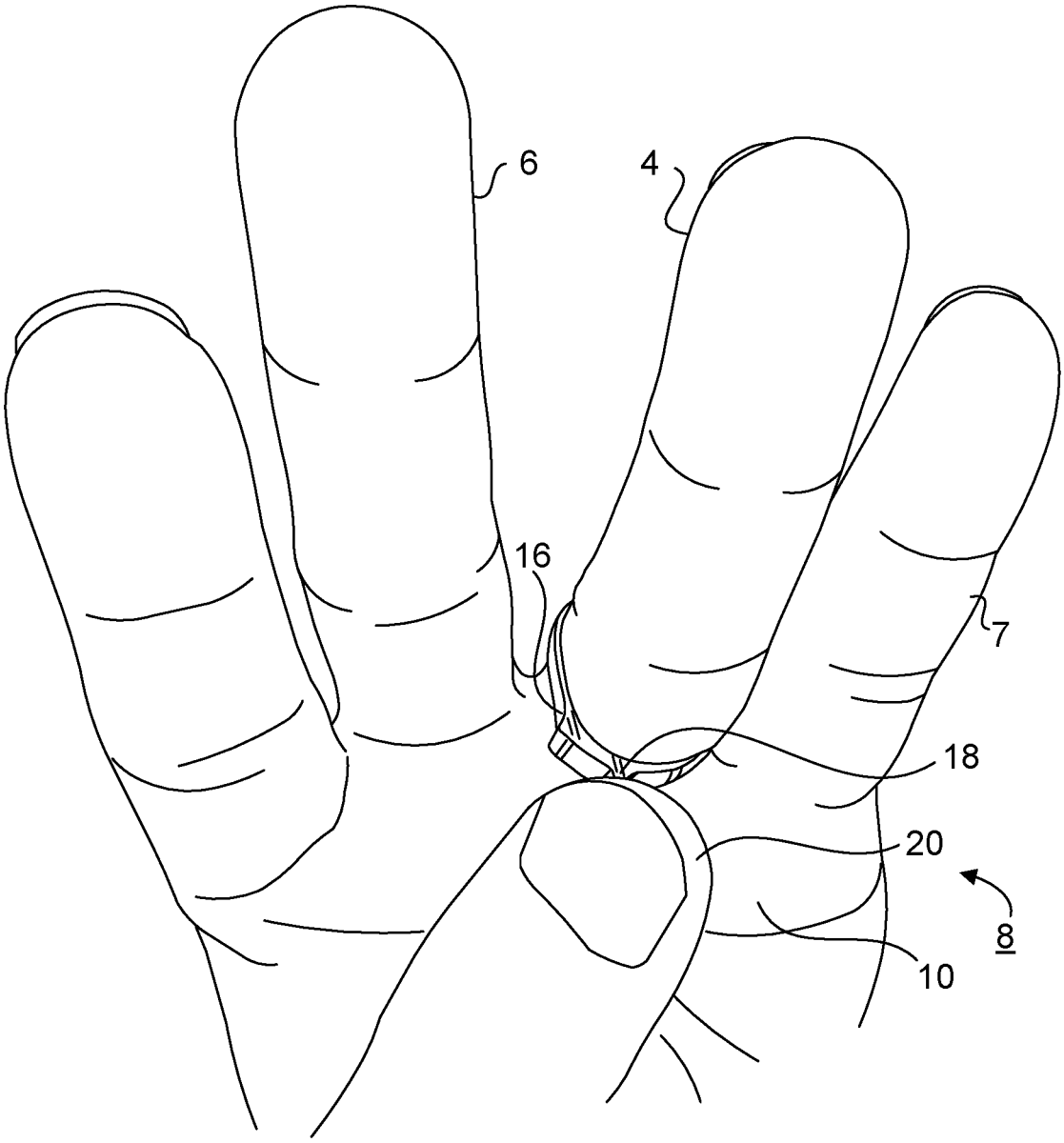
FIG. 11 is a diagram depicting the manner in which the roll angle of a present ring can be adjusted when worn on the ring finger.

FIG. 11 is a diagram depicting the manner in which the roll angle of a present ring can be adjusted when worn on the ring finger. In the embodiment shown, the ring further includes a knob disposed on the bottom portion, wherein the knob is configured to serve as a tactile indicator of the rotational position of the ring with respect to the finger and also as a grip for facilitating rotation of the ring to a desired rotational position. As the knob 18 is accessible to the thumb 20 of the same hand 8, the wearer can covertly adjust the roll angle without drawing attention to this action. If the roll position needs to be corrected, the wearer can correct the position by feel using the thumb of the same hand without engaging the ring by sight first. It shall also be noted that as the ring is disposed on the ring finger with the knob 18 centered in the middle, the rotation stop feature is located on the palm side between the middle finger 6 and ring finger 4.

Figure 12:
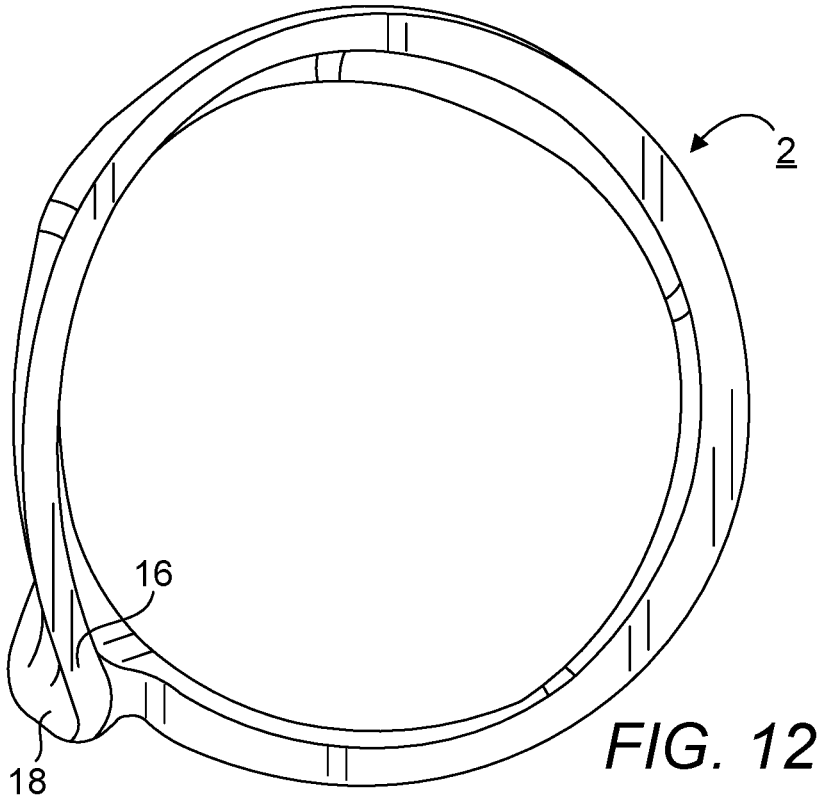
FIG. 12 is a right front perspective view of one embodiment of a present ring where a knob is integrally built with a rotation stop feature.

FIG. 12 is a right front perspective view of one embodiment of a present ring where a knob 18 is integrally built with a rotation stop feature 16. In this embodiment, the knob 18 is essentially an extension extending from one end of the curved segment of the rotation stop feature 16. Although less effective as a knob to provide grip for some, the integral knob simplifies the ring design.

Figure 13:
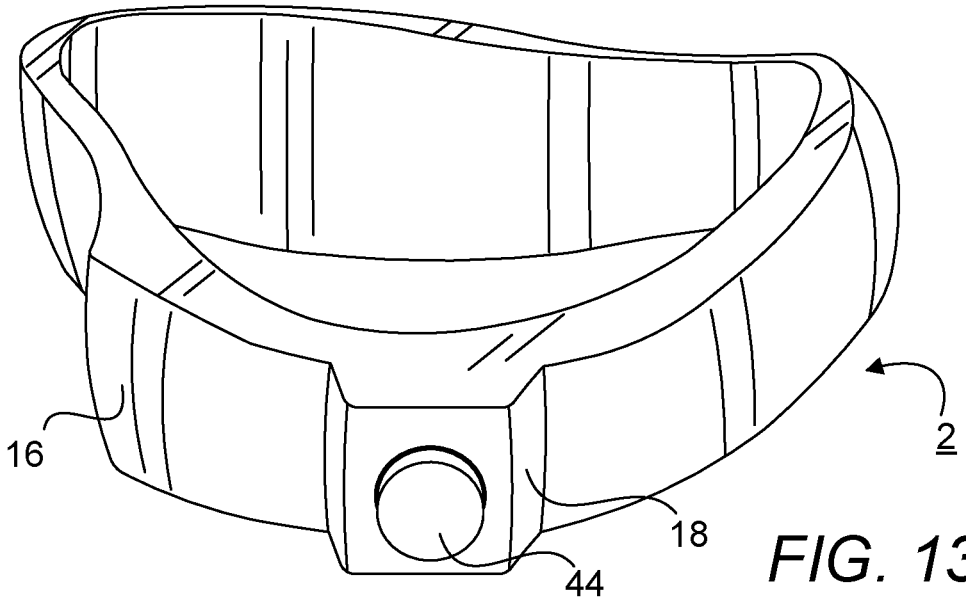
FIG. 13 is a bottom front perspective view of one embodiment of a present ring where a button is integrally built with a knob.

FIG. 13 is a bottom front perspective view of one embodiment of a present ring where a actuation button 44 or switch is integrally built with a knob, making the knob more prominent such that it can be more easily grasped. In this embodiment, the ring further includes an actuation button 44 disposed on the bottom portion, the actuation button 44 operably connected to an electronic device remotely. This actuation button 44 can be used to remotely cause, e.g., a warning by using a concealed action as the action needed to press this button can be achieved using the thumb of the same hand on which the ring is disposed. The parts constituting the switch form a structure suitable for use as a knob which provides grip for roll angle adjustment. In one embodiment, accidental actuations due to accidental depressions of the button 44 can be avoided by programming the manner in which actuations are interpreted. For instance, if three actuations are detected within a span of five seconds by the electronic device, the three actuations may be treated as a confirmation that a certain action is desired and a command may then be sent from the electronic device to a designated recipient.

The detailed description refers to the accompanying drawings that show, by way of illustration, specific aspects and embodiments in which the present disclosed embodiments may be practiced. These embodiments are described in sufficient detail to enable those skilled in the art to practice aspects of the present invention. Other embodiments may be utilized, and changes may be made without departing from the scope of the disclosed embodiments. The various embodiments can be combined with one or more other embodiments to form new embodiments. The detailed description is, therefore, not to be taken in a limiting sense, and the scope of the present invention is defined only by the appended claims, with the full scope of equivalents to which they may be entitled. It will be appreciated by those of ordinary skill in the art that any arrangement that is calculated to achieve the same purpose may be substituted for the specific embodiments shown. This application is intended to cover any adaptations or variations of embodiments of the present invention. It is to be understood that the above description is intended to be illustrative, and not restrictive, and that the phraseology or terminology employed herein is for the purpose of description and not of limitation. Combinations of the above embodiments and other embodiments will be apparent to those of skill in the art upon studying the above description. The scope of the present disclosed embodiments includes any other applications in which embodiments of the above structures and fabrication methods are used. The scope of the embodiments should be determined with reference to the appended claims, along with the full scope of equivalents to which such claims are entitled.

What is claimed herein is:

1. A ring for a finger of a user, the finger extending from a root of the finger at a palm of a hand at an angle that is not a right angle, said ring comprising a canted band comprising a cant angle, wherein said ring is capable to be worn by the user with said ring tangent to the palm at the root of the finger, increasing the comfort experienced by the user as said ring is disposed on the finger of the user and increasing the secure coupling of said ring to the finger by disposing said ring against said palm, wherein said canted band further comprises a bottom portion and said ring further comprises a rotation stop feature disposed on said bottom portion, said rotation stop feature comprising a curved segment configured to partially cup a second finger adjacent the finger and said curved segment is disposed between the second finger and the finger while said ring is disposed on the finger, to prevent rotation of said ring about the finger and further increase the secure coupling of said ring to the finger by reducing turning of said ring about the finger.

2. The ring of claim 1, further comprising a knob disposed on a portion of said curved segment, wherein said knob is configured to serve as a tactile indicator of the rotational position of said ring with respect to the finger and as a grip for facilitating rotation of said ring to a desired rotational position.

3. The ring of claim 1, further comprising a knob disposed on said bottom portion, wherein said knob is configured to serve as a tactile indicator of the rotational position of said ring with respect to the finger and a grip for facilitating rotation of said ring to a desired rotational position.

4. The ring of claim 1, said curved segment comprises a radius of about ⅞ inch to about 1 and ⅛ inches and about 45 degrees sweep.

5. The ring of claim 1, wherein said cant angle is about 45 degrees.

6. The ring of claim 1, further comprising an actuation button disposed on said bottom portion, said actuation button operably connected to an electronic device.

7. A ring for a finger of a user, the finger extending from a root of the finger at a palm of a hand at an angle that is not a right angle, said ring comprising a band comprising a bottom portion and a rotation stop feature disposed on said bottom portion, said rotation stop feature comprising a curved segment configured to partially cup a second finger adjacent the finger and said curved segment is disposed between the second finger and the finger while said ring is disposed on the finger, to prevent rotation of said ring about the finger and increase the secure coupling of said ring to the finger in order to reduce turning of said ring about the finger, wherein said curved segment comprises a radius of about ⅞ inch to about 1 and ⅛ inches and about 45 degrees sweep.

8. The ring of claim 7, further comprising a knob disposed on a portion of said curved segment, wherein said knob is configured to serve as a tactile indicator of the rotational position of said ring with respect to the finger and a grip for facilitating rotation of said ring to a desired rotational position.

9. The ring of claim 7, wherein said band is a canted band comprising a cant angle, wherein said ring is capable to be worn by the user with said ring tangent to the palm at the root of the finger, increasing the comfort experienced by the user as the ring is disposed on the finger of the user and further increasing the secure coupling of said ring to the finger by disposing said ring against said palm.

10. The ring of claim 9, wherein said cant angle is about 45 degrees.

11. The ring of claim 7, further comprising a knob disposed on said bottom portion, wherein said knob is configured to serve as a tactile indicator of the rotational position of said ring with respect to the finger and a grip for facilitating rotation of said ring to a desired rotational position.

12. The ring of claim 7, further comprising an actuation button disposed on said bottom portion, said actuation button operably connected to an electronic device.

* * * * *